US005434043A

United States Patent [19]

Zou et al.

[11] Patent Number: 5,434,043

[45] Date of Patent: Jul. 18, 1995

[54] PHOTOTHERMOGRAPHIC ELEMENT WITH PRE-FORMED IRIDIUM-DOPED SILVER HALIDE GRAINS

[75] Inventors: Chaofeng Zou, Maplewood; James B. Philip, Mahtomedi; Steven M. Shor, Woodbury; Mark C. Skinner, Afton; Pu Zhou, Woodbury, all of Minn.

[73] Assignee: Minnesota Mining and Manufacturing Company, St. Paul, Minn.

[21] Appl. No.: 239,984

[22] Filed: May 9, 1994

[51] Int. Cl.[6] ..... G03C 1/498

[52] U.S. Cl. ..... 430/619; 430/203; 430/567; 430/569; 430/604

[58] Field of Search ..... 430/619, 567, 569, 604, 430/203

[56] References Cited

U.S. PATENT DOCUMENTS

| | | | |
|---|---|---|---|
| 3,890,154 | 6/1975 | Ohkubo et al. . | |
| 3,901,711 | 8/1975 | Iwaosa et al. . | |
| 3,901,713 | 8/1975 | Yamasue et al. . | |
| 3,979,213 | 9/1976 | Gilman, Jr., et al. . | |
| 4,161,408 | 7/1979 | Winslow et al. | 430/620 |
| 4,336,321 | 6/1982 | Kanada et al. . | |
| 4,565,778 | 1/1986 | Miyamoto et al. | 430/567 |
| 4,621,041 | 11/1986 | Saikawa et al. . | |
| 4,828,962 | 5/1989 | Grzeskowiak et al. | 430/604 |
| 5,028,523 | 7/1991 | Skoug | 430/617 |
| 5,051,344 | 9/1991 | Kuno | 430/604 |
| 5,064,753 | 11/1991 | Sobei et al. | 430/619 |
| 5,227,286 | 7/1993 | Kuno et al. | 430/567 |

FOREIGN PATENT DOCUMENTS

| | | |
|---|---|---|
| 4-51043 | 2/1992 | Japan . |
| 4251244 | 9/1992 | Japan . |
| 4348338 | 12/1992 | Japan . |
| 4358144 | 12/1992 | Japan . |
| 5053239 | 3/1993 | Japan . |
| 5-127334 | 5/1993 | Japan . |
| 1241662 | 8/1971 | United Kingdom . |
| 1367700 | 9/1974 | United Kingdom . |

OTHER PUBLICATIONS

U.S. patent application Ser. No. 08/202,941 filed 02/28/94 (Docket No. 49921USA5A).

*Primary Examiner*—Thorl Chea

*Attorney, Agent, or Firm*—Gary L. Griswold; Walter N. Kirn; Mark A. Litman

[57] ABSTRACT

A negative-acting photothermographic element comprising a support bearing at least one heat-developable, photosensitive, image-forming photothermographic emulsion layer comprising:

(a) an iridium doped, preferably iridium-doped core-shell, photosensitive silver halide grains, generally containing a total silver iodide content of less than 10 mole %, the shell having a second silver iodide content lower than the silver iodide content of the core;

(b) a non-photosensitive, reducible source of silver;

(c) a reducing agent for the non-photosensitive, reducible source of silver;

(d) a binder; and (e) optionally at least one compound selected from the group consisting of: a halogen molecule; an organic haloamide; and hydrobromic acid salts of nitrogen-containing heterocyclic compounds which are further associated with a pair of bromine atoms.

A process of forming photothermographic emulsions from iridium-doped silver halide grains by forming silver soaps in the presence of those grains is also described.

46 Claims, 1 Drawing Sheet

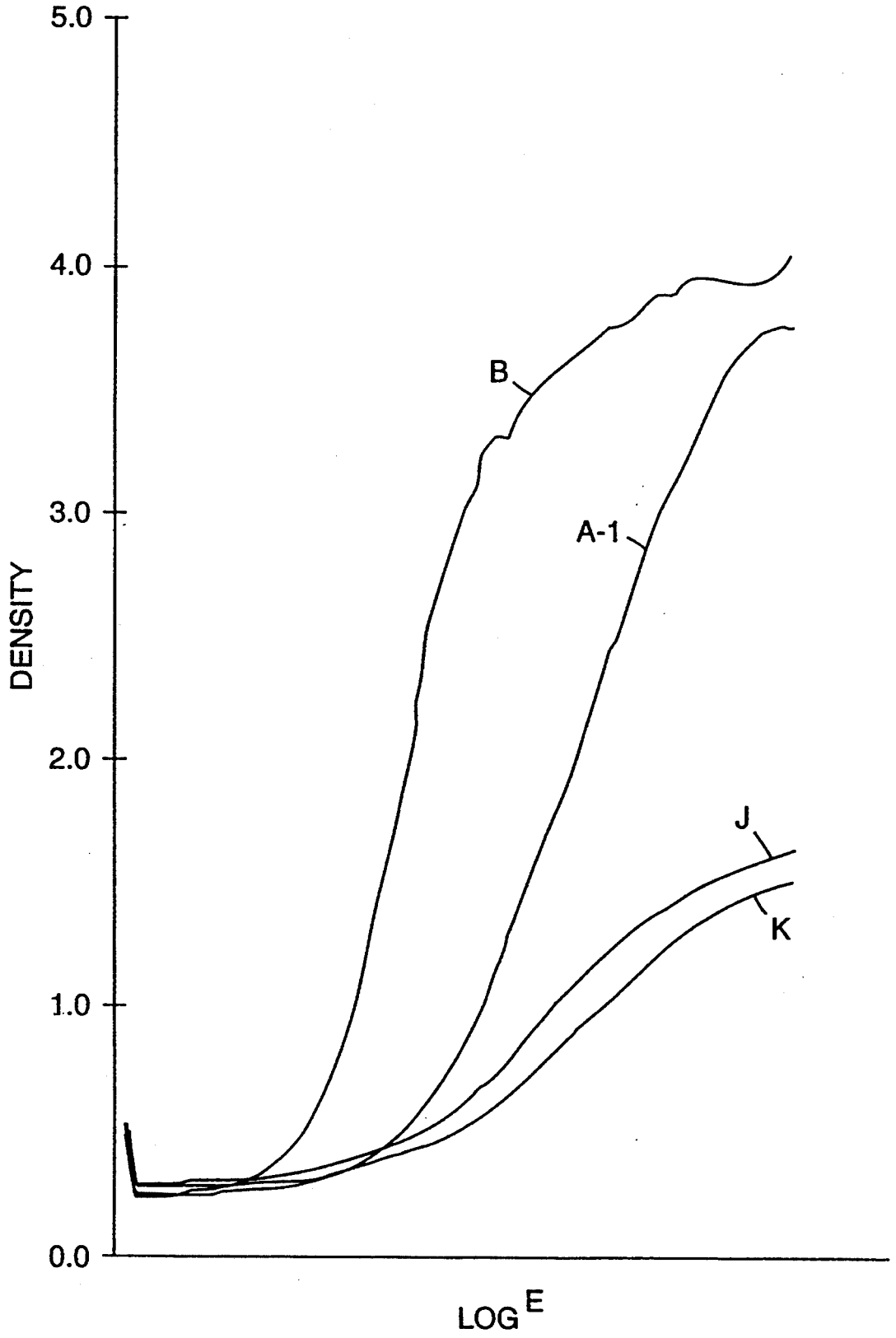
5.0
4.0
3.0
2.0
1.0
0.0
DENSITY
B
A-1
J
K
LOG E

PHOTOTHERMOGRAPHIC ELEMENT WITH PRE-FORMED IRIDIUM-DOPED SILVER HALIDE GRAINS

BACKGROUND OF THE INVENTION

1. Field of the Invention

This invention relates to a photothermographic element and in particular, it relates to a photothermographic element containing pre-formed iridium-doped silver halide grains and preferably pre-formed iridium doped core-shell silver halide grains.

2. Background to the Art

Silver halide-containing photothermographic imaging materials (i.e., heat-developable photographic elements) processed with heat, and without liquid development, have been known in the art for many years. These materials, also known as "dry silver" compositions or emulsions, generally comprise a support having coated thereon: (1) a photosensitive material that generates elemental silver when irradiated; (2) a non-photosensitive, reducible silver source; (3) a reducing agent for the non-photosensitive reducible silver source; and (4) a binder. The photosensitive material is generally photographic silver halide which must be in catalytic proximity to the non-photosensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source. It has long been understood that elemental silver ($Ag^{\circ}$) is a catalyst for the reduction of silver ions, and the photosensitive photographic silver halide may be placed into catalytic proximity with the non-photosensitive, reducible silver source in a number of different fashions, such as by partial metathasis of the reducible silver source with a halogen-containing source (see, for example, U.S. Pat. No. 3,457,075); by coprecipitation of silver halide and reducible silver source material (see, for example, U.S. Pat. No. 3,839,049); and other methods that intimately associate the photosensitive photographic silver halide and the non-photosensitive, reducible silver source.

The non-photosensitive, reducible silver source is a material that contains silver ions. Typically, the preferred non-photosensitive reducible silver source is a silver salt of a long chain aliphatic carboxylic acid typically having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms ($Ag^{\circ}$ ). The imagewise distribution of these clusters is known in the art as a latent image. This latent image generally is not visible by ordinary means and the photosensitive emulsion must be further processed in order to produce a visible image. The visible image is produced by the reduction of silver ions, which are in catalytic proximity to silver halide grains bearing the clusters of silver atoms, i.e. the latent image. This produces a black-and-white image.

As the visible image is produced entirely by elemental silver ($Ag^{\circ}$), one cannot readily decrease the amount of silver in the emulsion without reducing the maximum image density. However, reduction of the amount of silver is often desirable in order to reduce the cost of raw materials used in the emulsion.

One method of attempting to increase the maximum image density in black-and-white photographic and photothermographic emulsions without increasing the amount of silver in the emulsion layer is by incorporating toning agents into the emulsion. Toning agents improve the color of the silver image of the photothermographic emulsions, as described in U.S. Pat. Nos. 3,846,136; 3,994,732; and 4,021,249.

Another method of increasing the maximum image density of photographic and photothermographic emulsions without increasing the amount of silver in the emulsion layer is by incorporating dye-forming materials in the emulsion and producing color images. For example, color images can be formed by incorporation of leuco dyes into the emulsion. A leuco dye is the reduced form of a color-bearing dye. It is generally colorless of very lightly colored. Upon imaging, the leuco dye is oxidized, and the color-bearing dye and a reduced silver image are simultaneously formed in the exposed region. In this way a dye enhanced silver image can be produced as shown, for example in U.S. Pat. Nos. 4,187,108; 4,374,921; and 4,460,681.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747; and Research Disclosure, March 1989, item 29963.

With the increased availability of low-irradiance light sources such as light emitting diodes (LED), cathode ray tubes (CRT), and semi-conductor laser diodes, have come efforts to produce high-speed, photothermographic elements which require shorter exposure times. Such photothermographic systems would find use in, for example, conventional black-and-white or color photothermography, in electronically-generated black-and-white or color hardcopy recording, in graphic arts laser recording, for medical diagnostic laser imaging, in digital color proofing, and in other applications.

Various techniques are typically employed to try and gain higher sensitivity in a photothermographic material. These techniques center around making the silver halide crystals' latent image centers more efficient such as by introducing imperfections into the crystal lattice or by chemical sensitization of the silver halide grains and by improving the sensitivity to particular wavelengths of light by formulating new improved sensitizing dyes or by the use of supersensitizers.

In efforts to make more sensitive photothermographic materials, one of the most difficult parameters to maintain at a very low level is the various types of fog or $D_{min}$. Fog is spurious image density which appears in non-imaged areas of the element after development and is often reported in sensitometric results as $D_{min}$. Photothermographic emulsions, in a manner similar to photographic emulsions and other light-sensitive systems, tend to suffer from fog.

Traditionally, photothermographic materials have suffered from fog upon coating. The fog level of freshly prepared photothermographic elements will be referred to herein as initial fog or initial $D_{min}$.

In addition, the fog level of photothermographic elements often rises as the material is stored, or "ages." This type of fog will be referred to herein as shelf-aging fog. Adding to the difficulty of fog control on shelf-aging is the fact that the developer is incorporated in the photothermographic element. This is not the case in most silver halide photographic systems. A great amount of work has been done to improve the shelf-life characteristics of photothermographic materials.

A third type of fog in photothermographic systems results from the instability of the image after processing. The photoactive silver halide still present in the developed image may continue to catalyze formation of metallic silver (known as "silver print-out") during room light handling or post-processing exposure such as in graphic arts contact frames. Thus, there is a need for post-processing stabilization of photothermographic materials.

Without having acceptable resistance to fog, a commercially useful material is difficult to prepare. Various techniques have been employed to improve sensitivity and maintain resistance to fog.

U.S. Pat. No. 3,839,049 discloses a method of associating pre-formed silver halide grains with an organic silver salt dispersion. U.S. Pat. No. 4,161,408 (Winslow et al.) discloses a method of associating a silver halide emulsion with a silver soap by forming the silver soap in the presence of the silver halide emulsion. No sensitometric benefits for the process of this patent as compared to U.S. Pat. No. 3,839,049 are asserted. The process of U.S. Pat. No. 4,161,408 comprises adding silver halide grains with agitation to a dispersion of a long-chain fatty acid in water, with no alkali or metal salt of said fatty acid present while the acid is maintained above its melting point, then converting the acid to its ammonium or alkali metal salt, cooling the dispersion, and then converting the ammonium or alkali metal salt to a silver salt of the acid.

U.S. Pat. No. 4,212,937 describes the use of a nitrogen-containing organic base in combination with a halogen molecule or an organic haloamide to improve storage stability and sensitivity.

Japanese Patent Kokai 61-129 642, published Jun. 17, 1986, describes the use of halogenated compounds to reduce fog in color-forming photothermographic emulsions. These compounds include acetophenones such as phenyl($\alpha,\alpha$-dibromobenzyl)ketone.

U.S. Pat. No. 4,152,160 describes the use of carboxylic acids, such as benzoic acids and phthalic acids, in photothermographic elements. These acids are used as antifoggants.

U.S. Pat. No. 3,589,903 describes the use of small amounts of mercuric ion in photothermographic silver halide emulsions to improve speed and aging stability.

U.S. Pat. No. 4,784,939 describes the use of benzoic acid compounds of a defined formula to reduce fog and to improve the storage stability of silver halide photothermographic emulsions. The addition of halogen molecules to the emulsions are also described as improving fog and stability.

U.S. Pat. No. 5,064,753 discloses a thermally-developable, photographic material containing core-shell silver halide grains that contain a total of 4–40 mole % of silver iodide and which have a lower silver iodide content in the shell than in the core. Incorporating silver iodide into the silver halide crystal in amounts greater than 4 mole % is reported to result in increased photosensitivity and reduced $D_{min}$. The silver halide itself is the primary component reduced to silver metal during development. The shelf stability properties of the preferred formulations are not addressed. This material is primarily used for color applications.

Japan Patent Kokai 63-300,234, published Dec. 7, 1988, discloses a heat-developable, photosensitive material containing a photosensitive silver halide, a reducing agent, and a binder. The photosensitive silver halide has a silver iodide content of 0.1~40 mole % and a core/-shell grain structure. The photosensitive silver halide grains are further sensitized with gold. The material is reported to afford constructions with good sensitivity and low fog.

Japan Kokai 62-103,634, published May, 14, 1987; Japan Kokai 62-150,240, published Jul. 4, 1987; and Japan Kokai 62-229,241, published Oct. 8, 1987, describe heat-developable photosensitive materials incorporating core-shell shell grains with an overall iodide content greater that 4 mole %.

U.S. Pat. No. 5,028,523 discloses radiation-sensitive, thermally-developable imaging elements comprising; a photosensitive silver halide; a light-insensitive silver salt oxidizing agent; a reducing agent for silver ion; and an antifoggant or speed enhancing compound comprising hydrobromic acid salts of nitrogen-containing heterocyclic compounds which are further associated with a pair of bromine atoms. These antifoggants are reported to be effective in reducing spurious background image density.

It is well known in the photographic art that when there is an intense level of radiation fluence used during the exposure (such as with flash exposure or such as with a laser scanned exposure), a phenomenon occurs which is referred to in the art as high intensity reciprocity failure (HIRF). The high intensity exposure causes a reduction in the effective speed of the emulsion, it is believed, because the efficiency of the grain's ability to trap photons is reduced and/or there is a solarization effect where the silver halide grains are initially fogged (photoreduced to form metallic silver) by the radiation and then photooxidized by the additional amount of radiation above that needed to form a latent image. This effect has reduced the ability of silver halide emulsions to be used with high power imaging devices.

It has been found that the addition of certain dopants can aid in the reduction of high intensity reciprocity failure. Amongst the more preferred materials known in the art to reduce high intensity reciprocity failure is iridium doping of the silver halide grain. The use of iridium as a dopant for silver halide grains is taught in various different areas of technology. U.S. Pat. No. 4,621,041 teaches the use of iridium dopants in the silver halide component of diffusion transfer printing plates used in conjunction with scanning flash exposures. U.S. Pat. No. 4,288,535 teaches the use of iridium dopants with sulfur sensitizers during chemical ripening to maintain sensitivity and contrast when the emulsions are used with flash exposures (including scanned laser exposure). U.S. Pat. No. 4,173,483 teaches the use of Group VIII metal dopants (including iridium) as a means of reducing reciprocity failure in flash exposed silver halide emulsions. U.S. Pat. No. 4,126,472 teaches the addition of iridium dopants to silver halide grains in combination with hydroxytetrazaindenes and polyoxyethylene compounds. U.S. Pat. No. 4,469,783 discloses the addition of water-soluble iridium compounds to silver halide grains to maintain contrast, even when the grains are subjected to flash exposure. U.S. Pat. No. 4,336,321 discloses the use of iridium as a dopant alone or in combination with rhodium to improve silver halide emulsion performance.

EPO Publication No. 0 569 857 A1 discloses particularly desirable infrared absorbing dyes for use as antihalation dyes in photographic emulsions. The use of iridium dopants in forming the grains, although for no disclosed purpose, is shown.

U.S. Pat. No. 4,828,962 discloses the use of a combination of iridium and ruthenium dopants in silver halide emulsions to reduce high intensity reciprocity failure in photographic elements.

U.S. Pat. No. 4,725,534 discloses the use of metal halide salts to form silver halide on organic silver salts (silver salts of organic fatty acids). The invention emphasizes the growth of the silver halide on the fatty acids in an organic solvent for use in thermally developable photosensitive media (column 3, lines 21–45).

Japanese Patent Publication 90-087 358 discloses the use of iridium dopants in silver halide grains used in heat developable dye forming systems comprising silver halide (with iridium dopants) sensitized to the infrared, dye donative substance, reducing agent and binder.

Japanese Patent Publication Nos. 04-358 144 and 4-348 338 describe the use of iridium dopants in silver halide grains formed in organic solutions. The silver halide grains are then added to silver soaps to form a photothermographic element.

Japanese Patent Application No. 63-300 235 discloses the formation of silver halide grains by the in situ method on silver behenate soaps. The use of Group VIII metals (inclusive of iridium) during the in situ formation is also disclosed.

SUMMARY OF THE INVENTION

The present invention provides heat-developable, photothermographic elements capable of providing high photographic speed; stable, high density images of high resolution and good sharpness; and good shelf stability.

It has now been discovered that pre-formed, iridium-doped, silver halide grains with certain concentration ranges of silver iodide, preferably distributed in a core-shell configuration, which optionally may also be used in conjunction with either a halogen molecule; an organic haloamide compound; or compounds comprising hydrobromic acid salts of nitrogen-containing heterocyclic compounds which are further associated with a pair of bromine atoms, give enhanced photothermographic properties when used as part of a pre-formed dry silver soap formulation. A preferred construction for the iridium-doped grains of the present invention are core-shell emulsions, particularly those with less than 10% molar basis total iodide content in the halide, and more preferably less than 4% molar basis of total iodide content. By controlling the amounts and ratio of silver iodide in both the core and the shell, significant improvement over non-core-shell emulsions in sensitometric properties such as speed $D_{min}$ (i.e., lower initial fog), and shelf-life stability (i.e., shelf-aging fog) have been obtained while retaining the desired high sensitivity and $D_{max}$.

These negative-acting, heat-developable, photothermographic elements comprise a support bearing at least one photosensitive, image-forming, photothermographic emulsion layer comprising:

(a) iridium-doped, preferably iridium-doped core-shell photosensitive silver halide grains containing a total silver iodide content of less than 10 mole %, preferably less than 8 mole %, and more preferably less than 4 mole %, the core of the core-shell grain having a first silver iodide content of from about 4–14 mole % (although with small cores, the iodide content becomes less significant and may comprise between 40, 50, or even 100% of the halide content of the core or the core-shell emulsion), the shell having a second silver iodide content lower than the silver iodide content of the core;

(b) a non-photosensitive, reducible source of silver;

(c) a reducing agent for the non-photosensitive, reducible source of silver;

(d) a binder; and optionally (e) at least one compound selected from the group consisting of: a halogen molecule; an organic haloamide compound; and hydrobromic acid salts of nitrogen-containing heterocyclic compounds which are further associated with a pair of bromine atoms.

The reducing agent for the non-photosensitive, reducible source of silver may optionally comprise a compound capable of being oxidized to form or release a dye. Preferably, the dye-forming material is a leuco dye.

The iridium-doped core-shell photosensitive type silver halide grains used in the present invention should have an overall silver iodide content of less than 10 mole %, more preferably less than 4 mole %. The silver iodide content in the core of the core-shell grain is usually within the range of 4–14 mole %, and preferably, within the range of 6–10 mole %. For the silver halide composition of the shell, the silver iodide content is preferably within the range of 0–2 mole %.

A process for forming photothermographic emulsions and elements with iridium-doped preformed silver halide grains, particularly with formation of a silver soap in the presence of the pre-formed grains is also disclosed.

Other aspects, advantages, and benefits of the present invention include a negative-acting, photothermographic element comprising a support bearing at least one heat-developable, photosensitive, image-forming photothermographic emulsion layer comprising:

(a) pre-formed iridium-doped photosensitive silver halide grains in the presence of which a relatively non-photosensitive reducible silver source has been formed;

(b) said non-photosensitive, reducible source of silver;

(c) a reducing agent for said non-photosensitive, reducible source of silver; and (d) a binder, and a negative-acting, photothermographic element comprising a support bearing at least one heat-developable, photosensitive, image-forming photothermographic emulsion layer comprising:

(a) pre-formed iridium-doped photosensitive silver halide grains wherein fewer than 5% number average of said grains are agglomerated with other silver halide grains;

(b) a non-photosensitive, reducible source of silver;

(c) a reducing agent for said non-photosensitive, reducible source of silver; and (d) a binder, and a process for forming a photothermographic emulsion comprising the steps of providing an iridium-doped silver halide emulsion, adding said emulsion to an organic acid or a non-silver salt of an organic acid, and converting said non-silver salt or organic acid to a silver salt in the presence of said iridium-doped silver halide emulsion.

BRIEF DESCRIPTION OF THE DRAWING

FIG. 1 shows a graph of Optical Density (D) versus Log E for four different photothermographic elements, element B representing the preferred material of the present invention.

DETAILED DESCRIPTION OF THE INVENTION

The negative-acting photosensitive element of the present invention comprises a support having at least one photosensitive, image-forming, photothermographic emulsion layer comprising:

(a) iridium-doped, preferably iridium-doped core-shell, photosensitive silver halide grains containing a total silver iodide content of less than 10 mole % (preferably less than 8 mole %, more preferably less than 4 mole %), the core of a core shell emulsion grain having a first silver iodide content of from about 4–14 mole %, the shell having a second silver iodide content lower than the silver iodide content of the core;

(b) a non-photosensitive (i.e., relatively non-photosensitive at the exposure levels of the imaging fluence contemplated within the scope of the invention as well as that which is considered light-insensitive within the art), reducible source of silver;

(c) a reducing agent for the non-photosensitive, reducible source of silver;

(d) a binder; and optionally (e) at least one compound selected from the group consisting of a halogen molecule; an organic haloamide compound; or hydrobromic acid salts of nitrogen-containing heterocyclic compounds which are further associated with a pair of bromine atoms.

The reducing agent for the non-photosensitive, reducible silver source may optionally comprise a compound capable of being oxidized to form or release a dye. Preferably, the dye forming material is a leuco dye.

Improvements in photothermographic properties particularly can be attained by utilizing iridium-doped silver halide grains, and particularly iridium-doped core-shell (sometimes referred to as "layered") silver halide grains where the core contains 4–14 mole % silver iodide and the shell contains a lesser amount of silver iodide with the requirement that the total silver iodide contained in the silver halide grains is less than 4 mole %. Preferably, the core comprises up to 50 mole % of the total silver halide content in the silver halide grains. The grains may be grown by any variety of known procedures and to any grain size, however, it is preferable to grow grains that are less than 0.1 μm (0.1 micron or 0.1 micrometer). Grains of reduced size result in reduced haze and lower $D_{min}$.

The photothermographic elements of this invention may be used to prepare black-and-white, monochrome, or full-color images. The photothermographic element of this invention can be used, for example, in conventional black-and-white or color photothermography, in electronically-generated black-and-white or color hard-copy recording, in the graphic arts laser recording, for medical diagnostic laser imaging, in digital color proofing, and in other applications. The element of this invention provides high photographic speed, provides strongly absorbing black-and-white or color images, and provides a dry and rapid process while possessing low $D_{min}$.

The Photosensitive Pre-formed Iridium-Doped Silver Halide

The photosensitive, pre-formed, iridium-doped silver halide grains used in the present invention are preferably characterized by their iridium-doped core-shell structure wherein the surface layer (such as in the form of a shell) has a lower silver iodide content than the internal phase or bulk (such as in the form of a core). If the silver content in the surface layer of the iridium-doped core-shell silver halide grains is higher than or equal to that in the internal phase, disadvantages such as increased $D_{min}$ and increased fog upon storage or shelf aging, (as often simulated by accelerated aging at elevated temperature) will occur.

There is no particular limitation on the types of silver halides other than the iridium doping of the silver halide in the photosensitive silver halide grains, but preferable examples are silver iodobromide, silver chlorobromide, and silver chloroiodobromide. The difference in silver iodide content between the surface layer (shell) and internal phase (core) of a silver halide grain may be abrupt, so as to provide a distinct boundary, or diffuse so as to create a gradual transition from one phase to the other.

The silver iodide-containing core of the photosensitive silver halide grains may be prepared by the methods described in various references such as: P. Glafkides, *Chimie et Physique Photographique*, Paul Montel, 1967; G. F. Duffin, *Photographic Emulsion Chemistry*, The Focal Press, 1966; and V. L. Zelikman et al., *Making and Coating Photographic Emulsions*, The Focal Press, 1964.

An emulsion of the preferred iridium-doped core-shell silver halide grains used in the present invention may be prepared by first making cores from monodispersed photosensitive silver halide grains, then coating a shell over each of the cores. Monodispersed silver halide grains with desired sizes that serve as cores can be formed by using a "double-jet" method with the pAg being held at a constant level. In the double-jet method, the silver halide is formed by simultaneous addition of a silver source (such as silver nitrate) and a halide source (such as potassium chloride, bromide, or iodide) such that the concentration of silver (i.e., the pAg) is held at a constant level. Preparation of monodispersed silver halide grains using a double-jet method is described in Example 1 of this application.

A silver halide emulsion comprising highly monodispersed photosensitive silver halide grains to serve as cores for the iridium-doped core-shell emulsion may be prepared by employing the method described in Japanese Patent Application No. 48 521/79. A shell is then allowed to grow continuously on each of the thus prepared mono-dispersed core grains in accordance with the method employed in making the monodispersed emulsion. As a result, a silver halide emulsion comprising the mono-dispersed iridium-doped core-shell silver halide grains suitable for use in the present invention is attained.

The term "monodispersed silver halide emulsion" as used in the present invention means an emulsion wherein the silver halide grains present have such a size distribution that the size variance with respect to the average particle size is not greater than the level specified below. An emulsion made of a photosensitive silver halide that consists of silver halide grains that are uniform in shape and which have small variance in grain size (this type of emulsion is hereinafter referred to as a "monodispersed emulsion") has a virtually normal size distribution and allows its standard deviation to be readily calculated. If the spread of size distribution (%) is defined by (standard deviation/average grain size)$\times$100, then the monodispersed photosensitive silver halide grains used in the present invention preferably have a spread of distribution of less than 15% and, more preferably, less than 10%.

While it suffices for the iridium-doped core-shell photosensitive silver halide grains used in the present invention to have a lower silver iodide content in the surface layer (shell) than in the internal phase (core), the silver iodide content of the shell is preferably at least about 2–12 mole % lower than the silver iodide content of the core. The shell may be comprised of silver chloride, silver bromide, silver chlorobromide, or silver iodide.

It has also been clearly noted that in the photothermographic elements of the present invention that the use of mean average grain sizes less than 0.10 micrometers, preferably less than 0.09 micrometers, more preferably less than 0.075 micrometers, and most preferably less than 0.06 micrometers (one of ordinary skill in the art understanding that there is a finite lower practical limit for silver halide grains, partially dependent upon the wavelengths to which the grains are spectrally sensitized, such lower limit, for example being about 0.005 or 0.01 micrometers).

The average size of the photosensitive iridium-doped silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "*Particle Size Analysis,*" ASTM Symposium on Light Microscopy, R. P. Loveland, 1955, pp. 94–122; and in *The Theory of the Photographic Process,* C. E. Kenneth Mees and T. H. James, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Pre-formed iridium-doped silver halide emulsions in the element of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

The shape of the photosensitive iridium-doped silver halide grains of the present invention is in no way limited. The silver halide grains may have any crystalline habit including, but not limited to, cubic, tetrahedral, orthorhombic, tabular, laminar, twinned, platelet, etc. If desired, a mixture of these crystals may be employed.

The iridium dopant may be added at any time during the formation of the silver halide grains. It may be present throughout the grain formation process or added at various stages of the grain formation process. It is preferred that at least some iridium be present on the outer one-half of the "radius" of the grain, more preferably that there is at least some iridium present in the outer 10% (molar basis of silver halide) of the grain.

The iridium compounds used to provide the iridium dopant for the present invention may be water-soluble iridium compounds. Examples of such water-soluble iridium compounds include halogenated iridium (III) compounds, halogenated iridium (IV) compounds, and iridium complex salts containing as ligands halogen, amines, oxalate, etc. Such salts include hexachloroiridium (III) and (IV) complex salts, hexamineiridium (III) and (IV) complex salts, and trioxalateiridium (III) and (IV) complex salts. In the present invention, any combination of trivalent and tetravalent compounds among these compounds may be used. These iridium compounds may be used in the form of a solution in water or any other suitable solvent. In order to stabilize the iridium compound solution, any commonly used method can be employed. In particular, an aqueous solution of halogenated hydrogen (e.g., hydrochloric acid, hydrobromic acid) or halogenated alkali (e.g., KCl, NaCl, KBr, NaBr) can be added to the system. Instead of using a water-soluble iridium compound, other silver halide grains doped with iridium may be used during the preparation of the silver halide grains so that the iridium compound is dissolved in the system. The amount of iridium used within the silver halide grains of the present invention may usually be within the range of $1\times10^{-8}$ to $1\times10^{-2}$ mol iridium/mol silver, preferably $1\times10^{-7}$ to $1\times10^{-3}$ and more preferably $1\times10^{-6}$ to $1\times10^{-4}$ mol iridium/mol silver. The light sensitive iridium-doped silver halide used in the present invention can be employed in a range of 0.005 mole to 0.5 mole and, preferably, from 0.01 mole to 0.15 mole, per mole of non-photosensitive reducible source of silver. The silver halide may be added to the emulsion layer in any fashion which places it in catalytic proximity to the non-photosensitive reducible source of silver, although as will be clearly shown, the conversion of material to an organic silver soap in the presence of preformed silver halide grains is clearly the most preferred embodiment of the present invention.

Addition of sensitizing dyes to the iridium-doped silver halides of this invention serves to provide them with high sensitivity to visible and infrared light by spectral sensitization. The photosensitive silver halides may be spectrally sensitized with various known dyes that spectrally sensitize silver halide. Sensitization may be in the visible or infrared. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ moles, per mole of silver halide.

The Non-Photosensitive Reducible Silver Source Material

As noted above, the non-photosensitive silver salt which can be used in the present invention is a silver salt which is comparatively stable to light, but forms a silver image when heated to 80° C. or higher in the presence of an exposed photocatalyst (such as silver atoms) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof, etc. Silver salts which are substitutable with a halogen atom or a hydroxyl group can also be effectively used. Preferred examples of the silver salts of aromatic carboxylic acids and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Patent No. 3,330,663.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkylthioglycolic acid (wherein the alkyl group has from 12 to 22 carbon atoms); a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, or a silver salt of a thione compound such as a silver salt of 3-(2-carboxyethyl)-4-methyl-4-thiazoline-2-thione. Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include a silver salt of benzotriazole and derivatives thereof, for example, a silver salt of benzotriazole such as silver salt of methylbenzotriazole, etc., a silver salt of a halogen-substituted benzotriazole, such as a silver salt of 5-chlorobenzotriazole, etc., a silver salt of 1,2,4-triazole, or 1H-tetrazole as described in U.S. Pat. No. 4,220,709; and silver salts of imidazoles and imidazole derivatives.

It is also convenient to use silver half soaps. A preferred example of a silver half soap is an equimolar blend of silver behenate and behenic acid, prepared by precipitation from aqueous solution of the sodium salt of commercial behenic acid and containing about 14.5% silver.

Transparent sheet materials made on transparent film backing require a transparent coating and for this purpose the silver behenate full soap, containing not more than about 4 or 5 wt % of free behenic acid and containing about 25.2 wt % silver may be used. The method used for making silver soap dispersions is known in the art and is disclosed in *Research Disclosure*, April 1983, item no 22812; *Research Disclosure*, October 1983, item no. 23419; and U.S. Pat. No. 3,985,565.

Methods of preparing silver halide and organic silver salts and manners of blending them are described in Research Disclosure, No. 17029; U.S. Pat. Nos. 3,700,458 and 4,076,539; and Japanese Patent Application Nos. 13 224/74; 42 529/76; and 17 216/75.

The silver halide and the non-photosensitive reducible silver source material that form a starting point of development should be in "reactive association." By "reactive association" is meant that they should be in "catalytic proximity", which generally means in the practice of the present invention that they should be within same layer.

The iridium-doped silver halide grains and organic silver salt should be combined in a process in which the iridium-doped grains, and especially the iridium-doped core-shell silver halide grains are added to an alkali metal salt of an organic acid, followed by conversion to the silver salt of the organic acid. It is also effective to use a process which comprises adding a halogen-containing compound to the iridium-doped, especially the iridium-doped core-shell silver halide and the organic silver salt prepared to partially convert the silver of the organic silver salt to silver halide.

Photothermographic emulsions containing preformed silver halide in accordance with this invention can be sensitized with spectral sensitizers as described above.

The relatively light-insensitive source of reducible silver material generally constitutes from 15 to 70% by weight of the emulsion layer. It is preferably present at a level of 30 to 55% by weight of the emulsion layer.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered phenol reducing agents are preferred.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenyl-hydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidone-hexose reductone; sulfamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridine; bisphenols, e.g. , bis (2-hydroxy-3-t-butyl-5-methylphenyl)methane; 2,2-bis(4-hydroxy-3methylphenyl)propane; 4,4-ethylidene-bis (2-t-butyl-6-methylphenol); and 2,2-bis(3,5-dimethyl-4-hydroxyphenyl)propane; ascorbic acid derivatives, e.g., 1-ascorbylpalmitate, ascorbylstearate and unsaturated aldehydes and ketones; 3-pyrazolidones; and certain indane-1,3-diones.

The reducing agent should be present as 1 to 10% by weight of the imaging layer. In multilayer constructions, if the reducing agent is added to a layer other than an emulsion layer, slightly higher proportions, of from about 2 to 15%, tend to be more desirable.

The Optional Dye-Forming or Dye-Releasing Material

As noted above, the reducing agent for the reducible source of silver may be a compound that can be oxidized directly or indirectly to form or release a dye.

The dye-forming or releasing material may be any compound that can be oxidized to form or release a dye. When the photothermographic element used in this invention is heat developed, preferably at a temperature of from about 80° C. to about 250° C. (176° F. to 482° F.) for a duration of from about 0.5 to about 300 seconds, in a substantially water-free condition after or simultaneously with imagewise exposure, a mobile dye image is obtained simultaneously with the formation of a silver image either in exposed areas or in unexposed areas with exposed photosensitive silver halide.

Leuco dyes are one class of dye-releasing material that form a dye upon oxidation. Any leuco dye capable of being oxidized by silver ion to form a visible image can be used in the present invention. Leuco dyes that are both pH sensitive and oxidizable can be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes, i.e., blocked dye-releasing compounds, absorb less strongly in the visible region of the electromagnetic spectrum than do the dyes, i.e., the oxidized form of the leuco dyes and can be oxidized by silver ions back to the original colored form of the dye. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: indoaniline leuco dyes; imidazole leuco dyes, such as 2-(3,5-di-t-butyl-4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

Another preferred class of leuco dyes useful in this invention are those derived from so-called "chromogenic leuco dyes." Chromogenic dyes are prepared by oxidative coupling of a p-phenylenediamine compound or a p-aminophenol compound with a coupler. Reduction of the corresponding dye as described in U.S. Pat. No. 4,374,921 forms the chromogenic leuco dye. Leuco chromogenic dyes are also described in U.S. Pat. No. 4,594,307. Leuco chromogenic dyes having short chain carbamoyl protecting groups are described in copending application U.S. Ser. No. 07/939,093. For a review of chromogenic leuco dyes, see K. Venkataraman, *The Chemistry of Synthetic Dyes*, Academic Press: New York, 1952; Vol. 4, Chapter VI.

Another class of leuco dyes useful in this invention are "aldazine" and "ketazine" leuco dyes. Dyes of this type are described in U.S. Pat. Nos. 4,587,211 and 4,795,697.

Another class of dye-releasing materials that form a dye upon oxidation are known as pre-formed-dye-release (PDR) or redox-dye-release (RDR) materials. In these materials, the reducing agent for the organic silver compound releases a pre-formed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese Patent Application No. 165 054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent utilized in the present invention should preferably be in the range of 0.5–25 weight percent, and more preferably, in the range of 1–10 weight percent, based upon the total weight of each individual layer in which the reducing agent is employed.

The Binder

The photosensitive, iridium-doped, silver halide and the organic silver salt oxidizing agent used in the present invention are generally added to at least one binder as described herein below.

The binder(s) that can be used in the present invention can be employed individually or in combination with one another. It is preferred that the binder be selected from polymeric materials, such as, for example, natural and synthetic resins and that the binder be sufficiently polar to hold the other ingredients of the emulsion in solution or suspension. The binder may be hydrophilic or hydrophobic.

A typical hydrophilic binder is a transparent or translucent hydrophilic colloid, examples of which include a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders can be used individually or in combination with one another. Although the binder may be hydrophilic or hydrophobic, it is preferably hydrophobic.

The binders are generally used at a level of from about 20 to about 80% by weight of the emulsion layer, and preferably, from about 30 to about 55% by weight. Where the proportions and activities of leuco dyes require a particular developing time and temperature, the binder should be able to withstand those conditions. Generally, it is preferred that the binder not decompose or lose its structural integrity at 200° F. (90° C.) for 30 seconds, and more preferred that it not decompose or lose its structural integrity at 300° F. (149° C.) for 30 seconds.

Optionally, these polymers may be used in combination of two or more thereof. Such a polymer is used in an amount sufficient to carry the components dispersed therein, that is, within the effective range of the action as the binder. The effective range can be appropriately determined by one skilled in the art.

Fog Reducing Compounds

The generation of fog in photothermographic elements comprising an iridium-doped photosensitive silver halide; a non-photosensitive, reducible source of silver; a reducing agent for the non-photosensitive, reducible source of silver; and a binder, can be further reduced by the addition of a fog-reducing amount of hydrobromic acid salts of nitrogen-containing heterocyclic ring compounds which are further associated with a pair of bromine atoms; a halogen molecule; or an organic haloamide. These compounds are used in general amounts of at least 0.005 mole per mole of silver halide in the emulsion layer. Usually the range is between 0.005 and 1.0 mole of the compound per mole of silver halide and preferably between 0.01 and 0.3 mole of antifoggant per mole of silver. Nitrogen-containing heterocyclic ring compounds which are further associated with a pair of bromine atoms are described in Skoug, U.S. Pat. No. 5,028,523 incorporated herein by reference.

The Halogen Molecule

The halogen molecules which can be employed in this invention include iodine molecule, bromine molecule, iodine monochloride and iodine trichloride, iodine bromide and bromine chloride. The bromine chloride is preferably used in the form of a hydrate which is solid.

The term "halogen molecule" as used herein includes not only the above-described halogen molecules, but also complexes of a halogen molecule, for example, complexes of a halogen molecule with p-dioxane which are generally solid. Of the halogen molecules that can be used in this invention, iodine molecule which is solid under normal conditions is especially preferred.

The Organic Haloamide Compounds

The organic haloamide compounds which can be employed in this invention include, for example, N-chlorosuccinimide, N-bromosuccinimide, N-iodosucinimide, N-chlorophthalimide, N-bromophthalimide, N-iodophthalimide, N-chlorophthalazinone, N-bromophthalazinone, N-iodophthalazinone, N-chloroacetamide, N-bromoacetamide, N-iodoacetamide, N-chloroacetanilide, N-bromoacetanilide, N-iodoacetanilide, 1-chloro-3,5,5, -trimethyl-2,4-imidazolidinedione, 1-bromo-3,5,5, -trimethyl-2,4-imidazolidinedione, 1-iodo-3,5,5, -trimethyl-2,4-imidazolidinedione, 1,3-dichloro-5,5-dimethyl-2,4-imidazolidinedione, 1,3-dibromo-5,5-dimethyl-2,4-imidazolidinedione, 1,3-dibromo-5,5-dimethylimidazolidinedione, N,N-dichlorobenzenesulfonamide, N,N-dibromobenzenesulfonamide, N-bromo-N-methylbenzenesulfonamide, N-chloro-N-methylbenzenesulfonamide, N,N-diiodobenzenesulfonamide, N-iodo-N-methylbenzenesulfonamide, 1,3-dichloro-4,4-dimethylhydantoin, 1,3-dibromo-4,4-dimethylhydantoin, and 1,3-diiodo-4,4-dimethylhydantoin.

In general, the halogen molecules are more effective for improving both the sensitivity and the storage stability of the photosensitive materials than the organic haloamide compounds. The amount of the halogen molecules or the organic haloamide compounds typically ranges from about 0.001 mole to about 0.5 mole, and preferably from about 0.01 mole to about 0.2 mole, based on the mole of the organic silver salt oxidizing agent.

Photothermographic Formulations

The formulation for the photothermographic emulsion layer can be prepared by dissolving and dispersing the binder, the photosensitive pre-formed iridium-doped silver halide and non-photosensitive reducible source of silver, the reducing agent for the non-photosensitive reducible silver source (such as, for example, the optional leuco dye), and optional additives, in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10 percent by weight of the emulsion layer, preferably from 0.1 to 10 percent by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl-)aryldicarboximides, e.g. (N,N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diaza-octane)bis(isothiuronium)trifluoroacetate and 2-(tribromomethylsulfonyl benzothiazole); and merocyanine dyes such as 3-ethyl-5-[(3-ethyl-2-benzothiazolinylidene)-1-methyl-ethylidene]-2-thio-2,4-oazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, e.g., phthalic acid, 4-methylphthalic acid, 4-nitrophthalic acid, and tetrachlorophthalic anhydride; quinazolinediones, benzoxazine naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymtriazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H, 4H-2,3a,5,6a-tetrazapentalene, and 1,4-di(o-chlorophenyl)-3,6-dimercapto-1H, 4H-2,3a,5,6a-tetrazapentalene.

Photothermographic emulsions used in this invention may be further protected against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. Nos. 2,131,038 and 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the oximes described in G.B. Patent No. 623,448; the polyvalent metal salts described in U.S. Pat. No. 2,839,405; the isothiourea compounds described in U.S. Pat. No. 3,220,839; and palladium, platinum and gold salts described in U.S. Pat. Nos. 2,566,263 and 2,597,915.

Photothermographic elements of the invention may contain plasticizers and lubricants such as polyalcohols, e.g., glycerin and diols of the type described in U.S. Pat. No. 2,960,404; fatty acids or esters such as those described in U.S. Pat. Nos. 2,588,765 and 3,121,060; and silicone resins such as those described in G.B. Patent No. 955,061.

The photothermographic elements of the present invention may include image dye stabilizers. Such image dye stabilizers are illustrated by G.B. Patent No. 1,326,889; and U.S. Pat. Nos. 3,432,300; 3,574,627; 3,573,050; 3,764,337; and 4,042,394.

Photothermographic elements according to the present invention can be used in photographic elements which contain light-absorbing materials, antihalation, acutance, and filter dyes such as those described in U.S. Pat. Nos. 3,253,921; 2,274,782; 2,527,583; 2,956,879 and 5,266,452. If desired, the dyes can be mordanted, for example, as described in U.S. Pat. No. 3,282,699.

Photothermographic elements described herein may contain matting agents such as starch, titanium dioxide, zinc oxide, silica, and polymeric beads including beads of the type described in U.S. Pat. Nos. 2,992,101 and 2,701,245.

Photothermographic elements described herein can be used in photothermographic elements which contain antistatic or conducting layers, such as layers that comprise soluble salts, e.g., chlorides, nitrates, etc., evaporated metal layers, ionic polymers such as those described in 3,206,312; or insoluble inorganic salts such as those described in Trevoy, U.S. Pat. No. 3,428,451.

Photothermographic Constructions

The photothermographic elements of this invention may be constructed of one or more layers on a substrate. Single layer constructions should contain the preformed iridium-doped silver halide and silver source material, the developer, and optionally, at least one compound selected from the group consisting of: hydrobromic acid salts of nitrogen-containing heterocyclic compounds which are further associated with a pair of bromine atoms; a halogen molecule; or an organic haloamide; and binder as well as optional materials such as toners, dye-forming materials, coating aids, and other adjuvants.

Two-layer constructions should contain the silver source and silver halide in one emulsion layer (usually the layer adjacent to the substrate) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic elements, the various emulsion layers are generally maintained distinct from each other by the use of functional or non-functional barrier layers between the various photosensitive layers as described in U.S. Pat. No. 4,460,681.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and G.B. Patent No. 837,095. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and, more preferably, in the range 0.5 to 2.5, as measured by a MacBeth Color Densitometer Model TD 504. When used in color elements, a color filter complementary to the dye color should be used.

Additionally, it may be desirable in some instances to coat different emulsion layers on both sides of a transparent substrate, especially when it is desirable to isolate the imaging chemistries of the different emulsion layers.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Alternatively, the formulation may be spray-dried or encapsulated to produce solid particles, which can then be redispersed in a second, possibly different, binder and then coated onto the support.

The formulation for the emulsion layer can also include coating aids such as fluoroaliphatic polyesters.

The substrate with backside resistive heating layer may also be used in color photothermographic imaging systems such as shown in U.S. Pat. Nos. 4,460,681 and 4,374,921.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

The Support

Photothermographic emulsions used in the invention can be coated on a wide variety of supports. The support or substrate can be selected from a wide range of materials depending on the imaging requirement. Substrates may be transparent or opaque. Typical supports include polyester film, subbed polyester film, polyethylene terephthalate film, cellulose nitrate film, cellulose ester film, polyvinyl acetal film, polycarbonate film and related or resinous materials, as well as glass, paper, metal and the like. When a paper support is employed, it may be partially acetylated or coated with baryta and/or an α-olefin polymer, particularly a polymer of an alpha-olefin containing 2 to 10 carbon atoms such as polyethylene, polypropylene, ethylene-butene copolymers, and the like. Preferred polymeric materials for the support include polymers having good heat stability, such as polyesters. A particularly preferred polyester is polyethylene terephthalate.

The Image-Receiving Layer

When the reactants and reaction products of photothermographic systems that contain compounds capable of being oxidized to form or release a dye remain in contact after imaging, several problems can result. For example, thermal development often forms turbid and hazy color images because of dye contamination by the reduced metallic silver image on the exposed area of the emulsion. In addition, the resulting prints tend to develop color in unimaged background areas. This "background stain" is caused by slow reaction between the dye-forming or dye-releasing compound and reducing agent during storage. It is therefore desirable to transfer the dye formed upon imaging to a receptor, or image-receiving layer.

Thus, the photothermographic element may further comprise an image-receiving layer. Images derived from the photothermographic elements employing compounds capable of being oxidized to form or release a dye, such as, for example, leuco dyes, are typically transferred to an image-receiving layer.

If used, dyes generated during thermal development of light-exposed regions of the emulsion layers migrate under development conditions into the image-receiving or dye-receiving layer where they are retained. The dye-receiving layer can be composed of a polymeric material having an affinity for the dyes employed. Necessarily, it will vary depending on the ionic or neutral characteristics of the dyes.

The image-receiving layer of this invention can be any flexible or rigid, transparent layer made of thermoplastic polymer. The image-receiving layer preferably has a thickness of at least 0.1 μm, more preferably from about 1 to about 10 μm, and a glass transition temperature ($T_g$) of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably, from 1.5 to 3.5) or a transmission optical density in the range of from 0.2 to 2.5 (preferably, from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image-receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyester is "Fluorad FC 431", (a fluorinated surfactant, available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer to facilitate transfer of the dye that forms after the imagewise exposed emulsion layer is subjected to thermal development, for example, in a heated drum or a heated shoe-and-roller type heat processor.

Photothermographic multi-layer constructions containing blue-sensitive emulsions containing a yellow leuco dye may be overcoated with green-sensitive emulsions containing a magenta leuco dye. These layers may in turn be overcoated with a red-sensitive emulsion layer containing a cyan leuco dye. Imaging and heating form the yellow, magenta, and cyan images in an imagewise fashion. The dyes so formed may migrate to an image-receiving layer. The image-receiving layer may be a permanent part of the construction or may be removable "i.e., strippably adhered" and subsequently peeled from the construction. Color-forming layers may be maintained distinct from each other by the use of functional or non-functional barrier layers between the various photosensitive layers as described in U.S. Pat. No. 4,460,681. False color address, such as that shown in U.S. Pat. No. 4,619,892, may also be used rather than blue-yellow, green-magenta, or red-cyan relationships between sensitivity and dye formation. False color address is particularly useful when imaging is performed using longer wavelength light sources, especially red or near infrared light sources, to enable digital address by lasers and laser diodes. This is preferably accomplished by spectrally sensitizing at least one silver halide grain layer of the photothermographic element to wavelengths between 700 and 1100 nanometers, preferably between 720 and 1000 nanometers.

If desired, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Alternatively, a multi-colored image may be prepared by superimposing in register a single image-receiving sheet successively with two or more imagewise exposed photothermographic or thermographic elements, each of which release a dye of a different color, and heating to transfer the released dyes as described above. This method is particularly suitable for the production of color proofs especially when the dyes released have hues which match the internationally-agreed standards for color reproduction (SWOP colors). Dyes with this property are disclosed in U.S. Pat. No. 5,023,229. In this embodiment, the photothermographic or thermographic element preferably comprise compounds capable of being oxidized to release a preformed dye as this enables the image dye absorptions to be tailored more easily to particular requirements of the imaging system. When used in a photothermographic element, the elements are preferably all sensitized to the same wavelength range regardless of the color of the dye released. For example, the elements may be sensitized to ultraviolet radiation with a view toward contact exposure on conventional printing frames, or they may be sensitized to longer wavelengths, especially red or near infrared to enable digital address by lasers. As noted above, false color address is again particularly useful when imaging is performed using longer wavelength light sources, especially red or near infrared light sources, to enable digital address by lasers and laser diodes.

Reasonable modifications and variations are possible from the foregoing disclosure without departing from either the spirit or scope of the invention as defined by the claims. Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXAMPLES

All materials used in the following examples were readily available from standard commercial sources such as Aldrich Chemical Co. (Milwaukee, Wis.) unless otherwise specified. The following additional terms and materials were used.

Butvar TM B-79 is a poly(vinyl butyral) available from Monsanto Company, St. Louis, Mo. Desmodur TM N3300 is an isocyanate available from Mobay Chemicals, Pittsburgh, Pa.

MEK is methyl ethyl ketone (2-butanone).

PET is poly(ethylene terephthalate) Dye-1 has the following structure and is disclosed in U.S. patent application Ser. No. 08/202,942, filed Feb. 28, 1994.

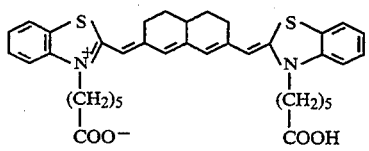

2-(tribromomethylsulphonyl)quinoline has the following structure:

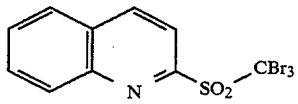

PREPARATION

Preparation of Non-Core-Shell Silver Iodobromide Emulsions:

Non-core-shell iridium-doped silver iodobromide emulsions D and E were prepared by double-jet addition in aqueous phthalated gelatin solution at controlled pAg and temperature conditions by the following procedure.

To a first solution (Solution A) having 100 g of phthalated gelatin dissolved in 1500 mL of deionized water, held at a temperature of 32° C., were simultaneously added; a second solution (Solution B) containing predetermined amounts of potassium iodide, potassium bromide, and an aqueous solution of an iridium salt ($2\times10^{-5}$ mole iridium/mole halide); and a third solution (Solution C) which was an aqueous solution containing 1.8 moles of silver nitrate ($AgNO_3$) per liter. pAg was held at a 2.0±0.1 by means of a pAg feedback control loop as described in *Research Disclosure* No. 17643; U.S. Pat. Nos. 3,415,650; 3,782,954; and 3,821,002. After a certain percentage of total delivered silver nitrate was added, the halide solution B was replaced with solution D which contained the same concentration of potassium iodide and potassium bromide as solution B, but also contained hexachloroiridate salt ($2.5\times10^{-5}$ mol/mol halide).

As a result, two silver iodobromide emulsions were obtained that were cubic, monodispersed silver halide having a 2% silver iodide content with a grain size of 0.045 μm. These emulsions were washed with water and desalted.

Preparation of Core-Shell Silver Iodobromide Emulsions:

Eight core-shell emulsions, A-1, A-2, B, C, F, G, H, and I, having different silver iodide content were prepared by the following procedure.

To a first solution (Solution A) having 50–100 g of phthalated gelatin dissolved in 1500 mL of deionized water, held at a temperature between 30°–38° C., were simultaneously added; a second solution (Solution B) containing predetermined amounts of potassium bromide, and potassium iodide, and in examples F, and G an aqueous solution of an iridium salt ($2\times10^{-5}$ mole iridium/mole halide); and a third solution (Solution C) which was an aqueous solution containing 1.4 to 1.8 moles silver nitrate per liter. pAg was held at a constant value by means of a pAg feedback control loop as described in *Research Disclosure* No. 17643, U.S. Pat. Nos. 3,415,650; 3,782,954; and 3,821,002. After a certain percentage of the total delivered silver nitrate was added, the second halide solution (Solution B), was replaced with Solution D which contained different predetermined amounts of potassium iodide and potassium bromide and iridium salt (in examples B, C, F, and G, H, and I); and Solution C was replaced with Solution E.

Thus, samples A-1 and A-2 employ core-shell grains containing no iridium, samples B, C, H, and I employ core-shell grains containing iridium only in the shell, samples D and E employ non core-shell grains containing iridium, and samples F and G employ core-shell grains containing iridium throughout the grain.

For illustration, the procedure for the preparation of 2 moles of emulsion B is shown below.

Solution A was prepared at 32° C. as follows:
gelatin 50 g
deionized Water 1500 mL
0.1M KBr 6 mL
adjust to pH=5.0 with 3N $HNO_3$ Solution B was prepared at 25° C. as follows:
KBr 27.4 g
KI 3.3 g
deionized Water 275.0 g Solution C was prepared at 25° C. as follows:
$AgNO_3$ 42.5 g
deionized Water 364.0 g Solutions B and C were jetted into Solution A over 9.5 minutes.

Solution D was prepared at 25° C. as follows:
KBr 179. g
$K_2IrCl_6$ 0.010 g
deionized Water 12. g Solution E was prepared at 25° C. as follows:
$AgNO_3$ 127. g
deionized Water 1090. g Solutions D and E were jetted into Solution A over 28.5 minutes.

The emulsion was washed with water and then desalted. The average grain size was 0.075 μm as determined by Scanning Electron Microscopy (SEM).

The composition, grain size, iridium salt used, and iridium distribution are shown in Table 1 below.

Preparation of Iridium-Doped Pre-formed Silver Halide/Silver Organic Salt Dispersion:

A silver halide/silver organic salt dispersion was prepared as described below. This material is also referred to as a silver soap dispersion or emulsion.

I. Ingredients

1. Pre-formed silver halide emulsion (non iridium-doped samples A-1 and A-2 or iridium-doped samples B through I) 0.10 mole at 700 g/mole in 1.25 liter $H_2O$ at 42° C.
2. 89.18 g of NaOH in 1.50 liter $H_2O$
3. 364.8 g of $AgNO_3$ in 2.5 liter $H_2O$
4. 118 g of Humko Type 9718 fatty acid (available from Witco. Co., Memphis, Tenn.)
5. 570 g of Humko Type 9022 fatty acid (available from Witco. Co., Memphis, Tenn.)
6. 19 mL of conc. $HNO_3$ in 50 mL $H_2O$ II. Reaction 1. Dissolve ingredients #4 and #5 at 80° C. in 13 liter of $H_2O$ and mix for 15 minutes.
2. Add ingredient #2 to Step 1 at 80° C. and mix for 5 minutes to form a dispersion.
3. Add ingredient #6 to the dispersion at 80° C., cooling the dispersion to 55° C. and stirring for 25 minutes.
4. Add ingredient #1 to the dispersion at 55° C. and mix for 5 minutes.

5. Add ingredient #3 to the dispersion at 55° C. and mix for 10 minutes.

6. Wash until wash water has a resistivity of 20,000 ohm/cm$^2$.

7. Dry at 45° C. for 72 hours.

Homogenization of Pre-formed Soaps (Homogenate):

A pre-formed silver fatty acid salt homogenate was prepared by homogenizing the pre-formed soaps, prepared above, in organic solvent and Butvar TM B-79 poly(vinyl butyral) according to the following procedure.

1. Add 345 g of pre-formed soap to 18 g of toluene, 1314 g of 2-butanone, and 36 g of Butvar TM B-79.

2. Mix the dispersion for 10 minutes and hold for 24 hours.

3. Homogenize at 4000 psi.

4. Homogenize again at 8000 psi.

Reaction of Pre-formed Homogenate with Halogen Containing Compounds:

The pre-formed homogenate (208 g) and 25 mL of 2-butanone were held at 70° F. with stirring. A solution of 0.16 g of pyridinium hydrobromide perbromide in 2 mL of methanol was added dropwise and the mixture allowed to stir at 70° F. for 1 hour. The addition of 1.00 mL of a calcium bromide solution (1 g of $CaBr_2$ and 10 g of methanol) was followed by stirring for 30 minutes to form a homogenized photothermographic emulsion. The photothermographic emulsion thus obtained contained either non-iridium doped pre-formed silver halide crystals or iridium-doped pre-formed silver halide crystals depending on the method of preparation.

Preparation of Photothermographic Light Sensitive Material:

To the homogenized photothermographic emulsion (240 g) prepared above was added a premixed solution containing the following:

0.026 g of Dye-1

0.128 g 2-mercapto-5-methylbenzimidazole (MMBI)

1.40 g of 2-(4-chlorobenzoyl)benzoic acid (CBBA)

5.0 g of methanol

The photothermographic emulsion was then stirred for 1 hour at 70° F. The mixture was then cooled to 55° F. and 40 g of Butvar TM B-79 was added. After stirring for 30 minutes, the following were than added in 15 minute increments with stirring.

1.10 g 2-(tribromomethylsulfonyl)quinoline 10.5 g 1,1-bis(2-hydroxy-3,5-dimethylphenyl)-3,5,5-trimethylhexane 0.27 g Desmodur TM N3300 isocyanate (THDI)

0.32 g tetrachlorophthalic acid (TCPA)

0.95 g phthalazine (PHZ)

A protective topcoat solution was prepared with the following ingredients:

82.0 g 2-butanone 10.0 g methanol 7.7 g cellulose acetate butyrate (Eastman CAB 171-15 S)

0.26 g 4-methylphthalic acid (4-MPA)

0.07 g tetrachlorophthalic anhydride (TCPAN)

Coating of Photothermographic Light Sensitive Material:

A double-knife coater was used to simultaneously coat the photothermographic emulsion and topcoat. The substrate used was 7 mil (178 μm) blue tinted poly(ethylene terphthalate) with an indolenine dye-containing antihalation layer coated on the back side. A sheet of substrate was placed on the coating bed and the knives lowered and locked into place. The height of the knives was adjusted with wedges controlled by screw knobs and measured with electronic gauges. Knife #1 was raised to a height corresponding to the thickness of the substrate plus the wet thickness of the photothermographic layer. Knife #2 was raised to a height corresponding to the thickness of the substrate plus the wet thickness of the photothermographic layer plus the desired wet thickness of the topcoat layer. The knives were adjusted to give a dry coating weight of 18 g/m$^2$ for the photothermographic layer and 2.4 g/m$^2$ for the topcoat layer. Aliquots of photothermographic emulsion and topcoat were poured onto the substrate in front of the corresponding knives. The substrate was drawn past the knives to produce a double layered coating in a single coating operation. The dual layer photothermographic element was placed in an oven and dried at 175° F. (79.4° C.) for 4 minutes.

Sensitometric and Thermal Stability Measurements:

The coated and dried photothermographic elements were cut into 1.5 inch by 8 inch strips (3.8 cm×20.3 cm) and exposed with a laser sensitometer incorporating a 810 nm laser diode. After exposure, the film strips were processed by heating at 250° F. (121° C.) for 15 seconds to give an image.

The images obtained were then evaluated on a custom-built, computer-scanned densitometer and are believed to be comparable to measurements obtainable from commercially available densitometers. Sensitometric results include $D_{min}$, D-Hi, Speed-2, Speed-3, and Contrast-1.

$D_{min}$ is the density of the non-exposed areas after development.

D-Hi is the density corresponding to an exposure at 1.40 log E beyond a density of 0.25 above $D_{min}$.

Speed-2 is 4-Log E (where E is the exposure in ergs/cm$^2$) needed to a achieve a density of 1.0 above $D_{min}$.

Speed-3 is 4-Log E (where E is the exposure in ergs/cm$^2$) needed to achieve a density of 2.9 above $D_{min}$. Speed-3 is important in evaluating the exposure response of a photothermographic element to high intensity light sources. It is also useful in determining the aging characteristics of the photothermographic element.

Contrast-1 is the slope of the line joining the density points of 0.50 and 1.70 above $D_{min}$.

Accelerated aging studies are a very good method of determining the degree of thermal fog that might result from natural storage and aging. Unexposed strips, prepared above, were aged in ovens maintained at 120° F./50% relative humidity (% RH). After 7 days, the samples were removed, exposed, and processed in a manner similar to the freshly coated samples.

TABLE I

| Composition, Grain Size, and Iridium Distribution of Silver Halide Grains | | | | |
|---|---|---|---|---|
| Sample | Core/Shell Halide Composition | Iridium Salt | Iridium Distribution | Grain Size μm |
| A-1 (Control) | 8% BrI/100% Br | No | | 0.075 |
| A-2 (Control) | 8% BrI/100% Br | No | | 0.090 |
| B | 8% BrI/100% Br | $K_2IrCl_6$ | Shell | 0.075 |
| C | 8% BrI/100% Br | $K_3IrCl_6$ | Shell | 0.075 |
| D | 2% BrI/2% BrI | $K_2IrCl_6$ | Shell | 0.075 |
| E | 2% BrI/2% BrI | $K_3IrCl_6$ | Shell | 0.075 |
| F | 8% BrI/100% Br | $K_2IrCl_6$ | Uniform | 0.075 |
| G | 8% BrI/100% Br | $K_3IrCl_6$ | Uniform | 0.075 |

TABLE I-continued

| Sample | Composition, Grain Size, and Iridium Distribution of Silver Halide Grains: Core/Shell Halide Composition | Iridium Salt | Iridium Distribution | Grain Size μm |
|---|---|---|---|---|
| H | 8% BrI/100% Br | $K_2IrCl_6$ | Shell | 0.065 |
| I | 8% BrI/100% Br | $K_2IrCl_6$ | Shell | 0.085 |

In all cases, the core of the core shell grain constituted approximately 25% molar basis of the total silver content of the grains.

EXAMPLE 1

This example demonstrates that iridium-doped emulsions give higher speed when imaged as shown below.

| Sample | Dmin | D-Hi | Speed-2 | Speed-3 | Contrast-1 |
|---|---|---|---|---|---|
| A-1 (Control) | 0.22 | 2.93 | 1.23 | 0.32 | 2.15 |
| B | 0.21 | 4.02 | 1.70 | 1.17 | 3.75 |
| C | 0.22 | 3.83 | 1.75 | 1.16 | 3.40 |

The exposure in ergs/cm$^2$ of the samples was determined by taking the anti-log of the 4-minus speed values. Samples B and C of this invention which contain iridium are faster (i.e., require a lower exposure) than control sample A-1 which contains no iridium.

| Sample | Exposure for Speed-2 | Exposure for Speed-3 |
|---|---|---|
| A-1 (Control) | 589 | 4,786 |
| B | 200 | 676 |
| C | 178 | 692 |

EXAMPLE 2

This example demonstrates iridium-doped, core-shell emulsions eliminate High Intensity Reciprocity Failure (HIRF). Two identical samples of each of the photothermographic elements were exposed to light with the same energy in two different ways. A first sample was exposed by scanning a film strip once using a laser diode sensitometer. A second sample (indicated by a *), was exposed on the same instrument with 3 scans each at $\frac{1}{3}$ of the energy. Both samples were then processed at same temperature for the same length of time. Control sample A-1 demonstrates the effect of high laser intensity and short exposure time which results in high intensity reciprocity failure.

| Sample | Dmin | D-Hi | Speed-2 | Speed-3 | Contrast-1 |
|---|---|---|---|---|---|
| A-1 (Control) | 0.22 | 2.93 | 1.23 | 0.32 | 2.15 |
| A-1 (Control)* | 0.22 | 3.47 | 1.39 | 0.69 | 3.40 |
| B | 0.21 | 4.02 | 1.70 | 1.17 | 3.75 |
| B* | 0.21 | 4.15 | 1.72 | 1.26 | 3.81 |
| C | 0.22 | 3.83 | 1.75 | 1.16 | 3.40 |
| C* | 0.21 | 3.99 | 1.75 | 1.21 | 3.47 |
| D | 0.21 | 3.95 | 1.68 | 1.36 | 5.46 |
| D* | 0.21 | 3.71 | 1.73 | 1.39 | 5.71 |
| E | 0.21 | 3.95 | 1.68 | 1.33 | 5.43 |
| E* | 0.20 | 3.84 | 1.71 | 1.34 | 5.53 |
| F | 0.21 | 3.84 | 1.67 | 1.27 | 5.16 |
| F* | 0.21 | 3.81 | 1.68 | 1.30 | 5.06 |
| G | 0.21 | 3.64 | 1.68 | 1.26 | 5.10 |
| G* | 0.21 | 3.74 | 1.71 | 1.34 | 5.29 |

The exposure in ergs/cm$^2$ of the samples were again determined by taking the anti-log of the speed values. Again, samples of this invention which contain iridium are faster (i.e., require a lower exposure) than control sample A-1 which contains no iridium.

| Sample | Exposure for Speed-2 | Exposure for Speed-3 |
|---|---|---|
| A-1 (Control) | 589 | 4,786 |
| A-1 (Control)* | 407 | 2,041 |
| B | 200 | 676 |
| B* | 191 | 550 |
| C | 178 | 692 |
| C* | 178 | 617 |
| D | 209 | 436 |
| D* | 186 | 407 |
| E | 209 | 468 |
| E* | 195 | 457 |
| F | 214 | 537 |
| F* | 195 | 501 |
| G | 209 | 550 |
| G* | 195 | 457 |

EXAMPLE 3

This example demonstrates iridium-doped emulsions give better contrast retention upon shelf aging.

| Sample | Sensitometry of Freshly Coated Samples: Dmin | D-Hi | Speed-2 | Speed-3 | Contrast-1 |
|---|---|---|---|---|---|
| A-2 Control | 0.21 | 3.26 | 1.81 | 0.96 | 3.44 |
| B | 0.21 | 3.84 | 1.72 | 1.32 | 5.27 |
| D | 0.21 | 3.95 | 1.68 | 1.36 | 5.46 |
| E | 0.21 | 3.95 | 1.68 | 1.33 | 5.43 |
| F | 0.21 | 3.84 | 1.67 | 1.27 | 5.16 |
| G | 0.21 | 3.64 | 1.68 | 1.26 | 5.10 |

| Sample | Sensitometry After 7 Day Accelerated Aging Test (120° F./50% RH): Dmin | D-Hi | Speed-2 | Speed-3 | Contrast-1 |
|---|---|---|---|---|---|
| A-2 Control | 0.22 | 3.17 | 1.59 | 0.72 | 2.33 |
| B | 0.21 | 3.85 | 1.50 | 1.09 | 4.38 |
| D | 0.21 | 3.99 | 1.50 | 1.12 | 4.65 |
| E | 0.21 | 3.96 | 1.51 | 1.12 | 4.55 |
| F | 0.21 | 3.82 | 1.44 | 1.03 | 4.15 |
| G | 0.21 | 3.74 | 1.47 | 1.05 | 4.37 |

EXAMPLE 4

This example demonstrates iridium-doped emulsions improve image sharpness. Four samples were prepared from pre-formed soaps containing the grains shown in Table 1 above. The emulsions were coated as above, but with a dry coating weight of 20 g/m$^2$ for the silver layer. Sample A-2 is a control and contains no iridium. Samples B, H, and I are iridium-doped core-shell grains and are within the scope of the invention.

TABLE 2

| Sample | Dmin | D-Hi | Speed-2 | Speed-3 | Contrast-1 |
|---|---|---|---|---|---|
| | Initial Sensitometry | | | | |
| A-2 | 0.23 | 4.03 | 1.80 | 1.39 | 4.43 |
| B | 0.23 | 4.20 | 1.87 | 1.58 | 5.50 |
| H | 0.23 | 4.39 | 1.71 | 1.40 | 5.17 |
| I | 0.24 | 4.16 | 1.87 | 1.50 | 4.98 |

Image sharpness was measured by exposing a test pattern (known as a Universal Test Pattern) on 8 inch×11 inch pieces of Samples A-2, B, H, and I. The device used to generate the images was a 3M Model 969 Laser Imager using a high powered 802 nm laser diode in place of the standard laser diode. The coatings were exposed to achieve a density of 3.10. Samples were developed for 15 seconds at 250° F. (121° C.) on a hot roll processor. The superior sharpness of the images made on the iridium containing samples B, H, and I was very apparent by visual inspection of the images.

The samples were also evaluated using a microdensitometer to measure the vertical bar pattern of the universal test pattern image. The bar pattern has various regions containing line pairs of varying frequency, known as line pairs/mm. A Sharpness Transfer Function Modulation (STF) value was calculated from the maximum and minimum density values using the following formula:

$$\text{Sharpness Transfer Function Modulation} = \frac{Dmax - Dmin}{Dmax + Dmin}$$

It is customary to plot Spatial Frequency (in line pairs/mm) along the x axis vs the value of STF along the y axis. The closer the plot is to a straight line, the sharper the image. The higher the modulation value, the sharper the image. A plot of the values shown below, indicates that the STF values for Samples B, H, and I, are "flatter" than those of Sample A-2 which contained no 3O iridium in the silver halide grain.

| Sample | 0.61 1 p/mm | 1.53 1 m/mm | 2.00 1 p/mm | 3.00 1 p/mm | 6.00 1 p/mm |
|---|---|---|---|---|---|
| | Modulation vs Spatial Frequency Spatial Frequency (1 p/mm) | | | | |
| A-2 | 0.88 | 0.89 | 0.88 | 0.84 | 0.35 |
| B | 0.90 | 0.90 | 0.90 | 0.89 | 0.59 |
| H | 0.88 | 0.88 | 0.87 | 0.87 | 0.60 |
| I | 0.89 | 0.89 | 0.90 | 0.89 | 0.54 |

Example 5

This example (and three comparative examples) illustrate the unexpected nature of the degree of improvement provided by combining pre-formed iridium-doped silver halide grains with a photothermographic emulsion process in which the grains are present during the formation of the silver soap. Sample B (of this invention) and Sample A-1 (a comparison) compare pre-formed iridium-doped silver halide grains present during the formation of the silver soap composition with iridium-doped silver halide grains physically added to silver soap compositions.

Sample B was prepared as described in Example 1. As noted above, in this process, a pre-formed iridium-doped, silver bromoiodide core-shell emulsion (formed in gelatin) was added to a sodium/fatty acid salt dispersion, and then silver nitrate was added to form a silver soap.

Sample A-1 (Comparison) was prepared as described in Example 1. As noted above, in this process, a pre-formed non-iridium doped silver silver bromoiodide core-shell emulsion (formed in gelatin) was added to a sodium/fatty acid salt dispersion, and then silver nitrate was added to form a silver soap.

Sample J (Comparison) was prepared from iridium-doped core-shell silver bromoiodide grains of emulsion B. Gelatin which had been on the silver halide grains as a peptizer for the the silver halide emulsion making process was removed by hydrolysis of the silver halide/gelatin emulsion with Proteolytic 200 enzymes (Solvay Enzymes, Inc. Elkhart, Ind.) at 40° C. for 48 hours, followed by centrifuge washing with deionized water, and then drying at 45° C. for 24 hours. These grains were added directly to a silver soap homogenate and mixed at 25° C. for 2 hours.

Sample K was made by direct addition of iridium-doped core-shell silver bromoiodide grains prepared in emulsion B above, to a silver behenate homogenate without removal of gelatin from the silver halide grains. The mixture was stirred at 25° C. for 2 hours.

All four samples were formulated and coated as described above in Example 1. All samples were imaged using a scanning laser sensitometer as described above. Care was taken to assure that all samples were exposed at the same wavelength, and with the same exposure intensity. All samples were developed by heating in the same manner. The sensitometry results are shown below.

| Sample | Dmin | D-Hi | Speed-2 | Contrast-1 |
|---|---|---|---|---|
| B | 0.231 | 3.801 | 1.835 | 4.431 |
| A-1 | 0.244 | 3.578 | 1.287 | 2.607 |
| J | 0.286 | 1.584 | 0.796 | — |
| K | 0.277 | 1.440 | 0.580 | — |

The exposure in ergs/cm$^2$ of the samples were again determined by taking the anti-log of the speed values. Again, sample B of this invention in which iridium was added to the pre-formed silver halide grain are faster (i.e., require a lower exposure) than comparison samples

| Sample | Exposure Required for Speed-2 |
|---|---|
| B | 146 |
| A-1 | 516 |
| J | 1,600 |
| K | 2,630 |

The data for the Density vs Log E results are plotted in FIG. 1. It can be seen that when pre-formed iridium-doped core-shell silver halide grains containing gelatin were added directly to the silver soap/organic solvent homogenate of sample K, a maximum density of only 1.44 was achieved. Even when gelatin was removed from the silver halide grains and the silver halide grains were physically asmixed with silver soap homogenate, i.e., sample J, the maximum dnesity increased to only 1.58. However, when pre-formed silver halide core-shell grains in gelatin were added to a sodium salt of a fatty acid and followed by converting the mixture to a pre-formed soap with silver nitrate, i.e., sample A-1, a significant increase in speed and denisty at a given speed was achieved. Finally, a further increase in speed and density was achieved when pre-formed iridium-doped core-shell silver halide grains were added to a sodium salt of a fatty acid in the soap preparation process, i.e., sample B of the invention. In this case, the close association of iridium-doped dilver halide grains with the silver salt of the fatty acid provide unexpectedly high level of optical density and improved speed It has been anecdotally observed that the photothermographic emulsions formed by converting non-silver organic salts to silver organic salts in the presence of iridium-doped silver halide appears to leave a particular fingerprint as compared to photothermographic emulsions formed by the mere physical admixture of silver halide and organic silver salt. There appears to be significantly less agglomeration of the silver halide grains in the former photothermographic emulsion. As a quantitative measure, the photothermographic emulsions formed by conversion of non-silver organic salt to silver organic salt in the presence of the silver halide grain appear to have fewer than 5% of the total number of silver halide grains physically touching other silver halide grains (as by agglomeration into effectively larger silver halide particles). In most cases, fewer than 4% of the grains, fewer than 3% of the grains, and even fewer than 1% or 2% of the grains are in actual physical contact with other silver halide grains. It is believed from observation of grain distribution within photothermographic elements in which preformed grains have been physically dispersed in silver soaps, that there is sometimes more than 10% by number of the silver halide grains in contact with each other. Even when good care is used in mixing and stirring of grains and silver soap, more than 5% of the grains can be in contact with other silver halide grains. Contact occurs between silver halide grains when the reductive development of a grain with a latent image causes development of a grain without a latent image thereon. Two such grains are in contact with one another. Usually this contact is an actau physical touching of the grains, but a bridging material or impurity which allows for this type of non-latent image development of a grain may also be present.

Another attribute of the preferred practice of the present invention is that the method of forming silver halide grains in an aqueous medium, with gelatin as a suspension or peptizing agent in the process, would appear to be able to provide better grain distribution, even when physically admixed with silver soaps. When used in processes where the silver soap is formed around the preformed grains (which will usually retain some amount of gelatin unless it is purposefully removed), the distribution (e.g., non-agglomeration) of the silver halide grains within the photothermographic emulsion and related performance characteristics also would tend to improve.

Reasonable modifications and variations are possible from the foregoing disclosure without departing from either the spirit or scope of the present invention as defined by the claims.

What is claimed is:

1. A negative-acting, photothermographic element comprising a support bearing at least one heat-developable, photosensitive, image-forming photothermographic emulsion layer comprising:

(a) core-shell photosensitive silver halide grains containing a total silver iodide content of less than 4 mole %, said core of said core-shell grains having a first silver iodide content of from about 4–100 mole % of the total silver iodide content, said shell having a second silver iodide content lower than the silver iodide content of said core; and being doped with iridium, (b) a non-photosensitive, reducible source of silver;

(c) a reducing agent for said non-photosensitive, reducible source of silver; and (d) a binder.

2. The photothermographic element according to claim 1 wherein said core contains up to 50 mole % of the total amount of silver present in said silver halide grains and the iodide content of said core is between 4 and 14% of the total halide content of said cores of said core-shell grains.

3. The photothermographic element according to claim 2 wherein core contains about 20–30 mole % of the total amount of silver present in said silver halide grains.

4. The photothermographic element according to claim 3 wherein said core contains about 25 mole % of the total amount of silver present in said silver halide grains.

5. The photothermographic element according to claim 1 wherein said shell further comprises silver bromide, silver chloride, or silver chlorobromide.

6. The photothermographic element according to claim 1 wherein said silver halide grains have an average diameter of less than about 0.1 μm.

7. The photothermographic element according to claim 6 wherein said silver halide grains are between about 0.02 to 0.08 μm in average diameter.

8. The photothermographic element according to claim 1 wherein said silver halide grains are sensitized to visible or infrared light.

9. The photothermographic element according to claim 1 wherein said non-photosensitive, reducible silver source is present in said photothermographic emulsion in an amount of from about 60 to 99 weight %.

10. The photothermographic element according to claim 9 wherein said non-photosensitive, reducible silver source is present in said photothermographic emulsion in an amount of from about 85 to 95 weight %.

11. The photothermographic element according to claim 1 wherein said non-photosensitive, reducible silver source is a silver salt of an aliphatic carboxylic acid having from 10 to 30 carbon atoms.

12. The photothermographic element according to claim 11 wherein said silver salt is silver behenate.

13. The photothermographic element according to claim 1 wherein said reducing agent for silver ion comprises a dye-releasable material capable of being oxidized to form or release a dye.

14. The photothermographic element according to claim 13 where said dye-releasable material is a leuco dye.

15. The photothermographic element according to claim 1 wherein said binder is hydrophobic.

16. The photothermographic element according to claim 1 wherein the silver iodide content of said shell is at least about 2–12 mole % lower than the silver iodide content of said core.

17. The photothermographic element of claim 1 wherein said emulsion contains at least one compound selected from the group consisting of a halogen molecule; an organic haloamide; and hydrobromic acid salts of nitrogen-containing heterocyclic compounds which are further associated with a pair of bromine atoms.

18. The photothermographic element according to claim 17 wherein said compound is one or more hydrobromic acid salts of a nitrogen-containing heterocyclic compound associated with a pair of bromine atoms.

19. The photothermographic element according to claim 18 wherein said nitrogen-containing heterocyclic compound associated with a pair of bromine atoms is pyridinium hydrobromide perbromide.

20. The photothermographic element according to claim 17 wherein said compound is a halogen molecule.

21. The photothermographic element according to claim 20 wherein halogen molecule is at least one compound selected from the group consisting of molecular iodine, molecular bromine, iodine monochloride, iodine trichloride, iodine bromide, and bromine chloride.

22. The photothermographic element according to claim 21 wherein said halogen molecule is molecular iodide.

23. The photothermographic element according to claim 17 wherein said compound is an organic haloamide.

24. The photothermographic element according to claim 23 wherein said organic haloamide is N-bromosuccinimide.

25. The photothermographic element of claim 1 wherein said silver halide grains contain less than 4% molar basis of silver iodide.

26. The photothermographic element of claim 1 wherein said silver halide grains contain less than 4% molar basis of iodide and the core of said iridium-doped core-shell grains contains from 4–14% molar basis of silver iodide.

27. The photothermographic element of claim 25 wherein said silver halide grains are spectrally sensitized to wavelengths between 720 and 1000 nanometers.

28. The photothermographic element of claim 26 wherein said silver halide grains are spectrally sensitized to wavelengths between 720 and 1100 nanometers.

29. A negative-acting, black and white photothermographic element comprising a support bearing at least one heat-developable, photosensitive, image-forming photothermographic emulsion layer comprising:

(a) core-shell photosensitive silver halide grains containing a total silver iodide content within said core-shell grains of less than 4 mole %, said core of said core-shell grains having a silver iodide content of from 4–100 mole % of the total silver iodide content, said shell having a silver iodide content which is less than the molar silver iodide content of said core, and said core-shell grains being doped with only iridium;

(b) a non-photosensitive, reducible source of silver;

(c) a reducing agent for said non-photosensitive reducible source of silver; and (d) a binder.

30. The element of claim 29 wherein said iridium is present within both the shell and core of said core-shell silver halide grains.

31. The element of claim 29 wherein said iridium is present only in said shell.

32. The element of claim 29 wherein said core-shell silver halide grains have an average diameter which is less than 0.10 microns, and wherein said core contains 20–30% of the total silver present within said core-shell grains.

33. The element of claim 32 wherein the silver iodide content of said shell is at least 2–12 mole % lower than the silver iodide content of said core.

34. The element of claim 33 wherein said core of said core-shell grains contains 4–14 molar % of silver iodide.

35. The element of claim 29 wherein said binder consists essentially of a hydrophobic polymeric binder.

36. The element of claim 1 wherein said binder consists essentially of a hydrophobic polymeric binder.

37. The element of claim 2 wherein said binder consists essentially of a hydrophobic polymeric binder.

38. The element of claim 3 wherein said binder consists essentially of a hydrophobic polymeric binder.

39. The emulsion of claim 5 wherein said binder consists essentially of a hydrophobic polymeric binder.

40. The element of claim 6 wherein said binder consists essentially of a hydrophobic polymeric binder.

41. The element of claim 7 wherein said binder consists essentially of a hydrophobic polymeric binder.

42. The element of claim 12 wherein said binder consists essentially of a hydrophobic polymeric binder.

43. The element of claim 23 wherein said binder consists essentially of a hydrophobic polymeric binder.

44. The element of claim 27 wherein said binder consists essentially of a hydrophobic polymeric binder.

45. The element of claim 27 wherein said binder consists essentially of a hydrophobic polymeric binder.

46. The element of claim 27 wherein said binder consists essentially of a hydrophobic polymeric binder.

* * * * *

UNITED STATES PATENT AND TRADEMARK OFFICE

CERTIFICATE OF CORRECTION

PATENT NO.: 5,434,043

DATED: July 18, 1995

INVENTOR(S): Zou et al.

It is certified that error appears in the above-identified patent and that said Letters Patent is hereby corrected as shown below:

Column 4, line 28, delete "core-shell shell" and insert --core-shell--.
Column 24, line 30, delete "12. g" and insert --812. g--.
Column 30, line 46, add the words --A-1, J, and K.--.

Signed and Sealed this

Thirteenth Day of August, 1996

*Attest:*

*Attesting Officer*

BRUCE LEHMAN

*Commissioner of Patents and Trademarks*